US006138559A

United States Patent [19]

Zimmer

[11] Patent Number: 6,138,559

[45] Date of Patent: Oct. 31, 2000

[54] MACHINING DEVICE FOR STRIPLIKE MATERIAL

[76] Inventor: Johannes Zimmer, Ebentaler Str. 133, 9020 Klagenfurt, Austria

[21] Appl. No.: 09/297,305

[22] PCT Filed: Oct. 29, 1997

[86] PCT No.: PCT/EP97/05960

§ 371 Date: Jun. 28, 1999

§ 102(e) Date: Jun. 28, 1999

[87] PCT Pub. No.: WO98/20193

PCT Pub. Date: May 14, 1998

[30] Foreign Application Priority Data

Nov. 2, 1996 [DE] Germany ..... 296 19 695 U

[51] Int. Cl.[7] ..... B30B 3/04

[52] U.S. Cl. ..... 100/160; 68/258; 100/170

[58] Field of Search ..... 100/160, 170; 68/258, 260, 262 R

[56] References Cited

U.S. PATENT DOCUMENTS

| | | | |
|---|---|---|---|
| 2,851,869 | 9/1958 | Quoos et al. | 100/160 |
| 2,878,778 | 3/1959 | Kusters . | |
| 3,592,036 | 7/1971 | Blain | 100/170 |
| 5,302,203 | 4/1994 | Zimmer | 100/170 |

FOREIGN PATENT DOCUMENTS

| | | | |
|---|---|---|---|
| 534930 | 3/1993 | European Pat. Off. . | |
| 1119809 | 12/1961 | Germany | 100/170 |
| 388174 | 6/1959 | Switzerland | 100/170 |

*Primary Examiner*—Stephen F. Gerrity
*Attorney, Agent, or Firm*—Mattingly, Stanger & Malur, P.C.

[57] ABSTRACT

An apparatus for processing web-shaped material (90) comprises a working roller (5), a counter support (6), a pressure bearing structure (3) for exerting driving force to said working roller (5), a supporting carrier (1) and a pressing device which comprises a pressure hose arranged between the pressure bearing structure (3) and a supporting wall (12). The pressure hose is formed by a pressure hose element (2.1) which, when the apparatus is viewed in longitudinal section, has a L-, U- or oval-shaped cross section and at least one bent portion (22) extending away from a counter support surface (31) for the hose rearwardly towards the rear side of the apparatus and a support portion (21) for making planar contact with the counter support surface (31) for the hose, a hose-free space (150) being formed at each filling state of the hose by each bent portion (22) in a flat cavity (15) between the counter support surface (31) for the hose and the support wall (12).

20 Claims, 5 Drawing Sheets

Figure 1:
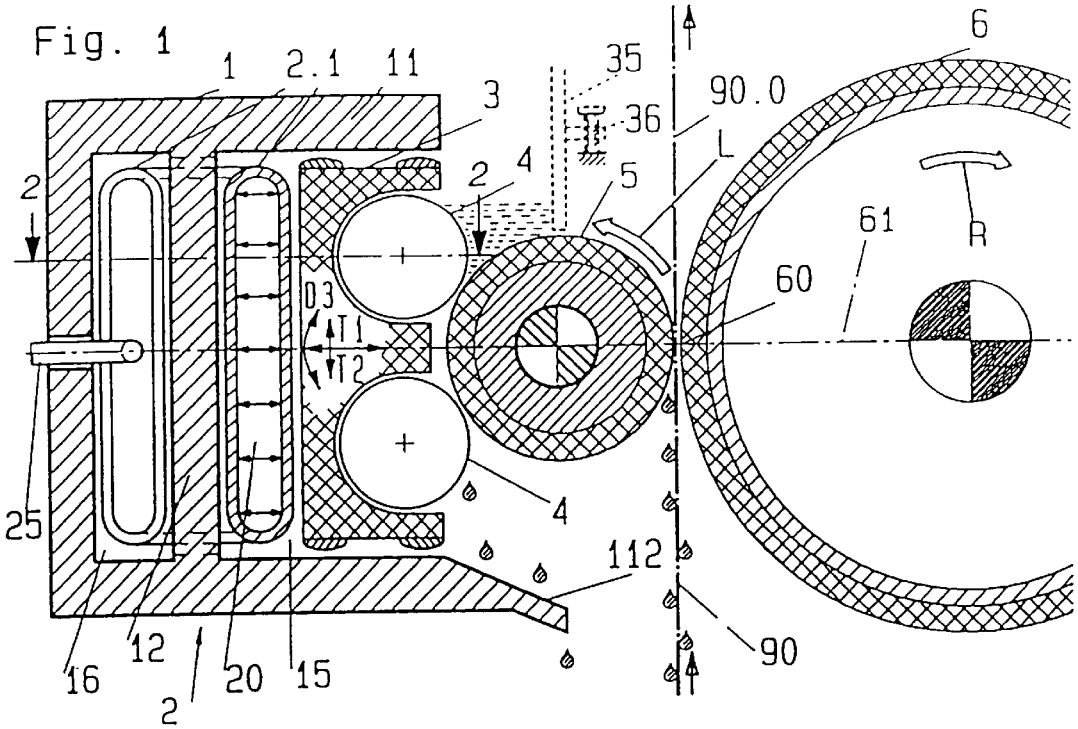

SECTIONAL VIEW 8-8
121
1
2.5
2.4
220
12
2.1

6
110
31
15
16
D
23
22
2.3
25
2.2
310
150
12
24
5
4
21
3
C
T4
T5
D6

MACHINING DEVICE FOR STRIPLIKE MATERIAL

The invention concerns an apparatus for processing web-shaped material comprising a working roller extending in the longitudinal direction of the apparatus, a counter support forming a counter support surface against which the web material is pressable over the whole working breadth, which corresponds to the web width, by means of the working roller, a pressure bearing structure with a front side for surface mounting the working roller on this front side and applying a pressing force to said working roller, a supporting carrier extending in the longitudinal direction of the apparatus, the pressure bearing structure and a supporting wall of the supporting carrier being arranged to be movable relative to one another in the pressing direction, and a pressing device for generating a pressing force, the pressing device comprising a cavity between said pressure bearing structure and said supporting wall, and a pressure hose arranged in said cavity, said cavity extending in the longitudinal direction of the apparatus and changing with said relative movement, a pressing chamber with oval or flat cross section being provided between a counter support surface for the hose formed on said pressure bearing structure and the supporting wall for applying a pressing force over the rear side of the pressure bearing structure, the pressing volume of said pressing chamber being defined by the amount of pressing medium contained in the hose.

An apparatus of this kind is known from U.S. Pat. No. 2,878,778. The press device with an inflatable pressure hose has proven particularly suitable for generating the desired high pressing forces on the working roller (nip roller). However adjustment problems and uneven roller running conditions occur and reoccur with these known apparatus and increased productivity demands specifically with regard to uniformity and the adjustability of the pressing force, require the use of relatively costly structures which increase production costs. An edge clamping attachment for the hose leads to wear and relatively short durability. Bearing rollers are axially mounted and guided in a pivotal frame on which the pressing force generated by means of the pressure hose is exerted. In another known apparatus (European Patent Specification No. 0 534 930) specific measures for allowing the flexible adjustment of the working roller are provided in which several separately controllable elements for generating pressing force are formed by pneumatic pistons.

Objects of the invention consist of improving the simplicity of construction, durability, operational security, maintenance, operation and the operating result of an apparatus of this type for processing web-shaped material.

These objects are achieved in connection with the features of the aforementioned apparatus in that the pressure hose is provided as a pressure hose element which comprises an L-, U- or oval-shaped form when the apparatus is viewed in longitudinal section, at least one bent portion directed away from the counter support surface for the hose towards the rear side of the apparatus and a supporting portion adapted to lie in planar fashion against said counter support surface for the hose, a hose free space being formed within said cavity at each filling state of the hose by each bent portion between said counter support surface for the hose and the supporting wall. According to the invention at least one end of the pressure hose element is bent backwards towards the rear longitudinal side of the apparatus. By virtue of the bent portion the pressure hose element will lie as uniformly as possibly against the support surface of the pressure bearing structure for the range of large to small working pressures and also can be accommodated entirely behind the bearing structure without the need for clamping connection means.

A particularly advantageous and useful embodiment of the invention is achieved when a working unit formed by the pressure bearing structure and the working roller in pressing relationship is arranged between the counter support and the pressure hose element such that the working unit is movable without restrictive guidance in both the pressing direction and transverse thereto. The pressure hose element arranged according to the invention works particularly effectively in co-operation with the pressure bearing structure which is arranged without restrictive guidance. The pressure bearing structure has three directions of movement for generating a pressing force when viewed in cross section. This means that each point of the pressure bearing structure can move in one plane in two directions perpendicular to one another while the bearing structure can also be rotated partially around this point. As a result of the surface mounting of the working roller on the pressure bearing structure, the working roller can also move with three degrees of freedom. When the working roller is in the pressing position and in operation, it is practically floating, i.e. mounted with neither translational nor rotational guidance relative to the support wall of the supporting carrier. The freely, ie. automatically attained parallel and inclined positions of the pressure bearing structure relative to the supporting wall of the supporting carrier is achieved as a result of the combination of the shape, conformability, and arrangement of the flat pressure hose element. It is apparent that the pressure bearing structure is arranged with a free clearance when in its pressing positions so that it can attain its positions between the pressure hose element and the working roller while moving freely. When operating, the working unit can adapt easily and automatically to the working conditions without the need for costly and complicated driving and control means. It has been found that both the operation and the result achieved are substantially improved as a result of allowing free movement in three degrees of freedom even when the clearance provided is relatively small, namely a few tenths of a millimeter, although it is useful to increase this clearance for larger operating breadths, i.e. when using a relatively long pressure bearing structure.

The material of the pressure hose element is usefully so resistant to stretching that even when particularly high pressing forces are used any intrusion of the bent portion of the hose into the hose-free space is reliably obviated.

In order that the hose element may be particularly easily and safely accommodated in a particularly compact pressing device the supporting carrier can comprise at least a second rear cavity arranged at the rear side of the apparatus, the bent portion of the hose extending into this second cavity while being supported on at least one inner wall of the cavity. The supporting wall can usefully be provided with openings for the hose bent portions. A particularly useful arrangement is obtained when the supporting wall forms a supporting core for a surrounding hose element between two openings. The rearwardly bent hose element according to the invention is particularly suited to provide a distribution of zones across the operational breadth. Thus, in a preferred embodiment of the invention, pressure hose elements are provided distributed in a row against the surface of the pressure bearing structure and hose free spaces are formed by the bent hose portions between adjacent hose support portions, separating the same, the rearwardly directed portions of adjacent bent portions being preferably in mutual pressing contact.

Preferably the supporting carrier can have an L or U-shaped cross section and be open towards the working roller, at least one leg of the supporting carrier usefully forming a positioning element for the pressure bearing structure and each leg of the supporting carrier preferably extending beyond the pressure bearing structure.

The supporting carrier can usefully be adjustable to alter its position relative to the counter support and fixable in any position by means of a holding device. In this connection a particularly advantageous embodiment of the invention is obtained when a moving device for adjusting and fixing the spacing between the supporting carrier and the counter support is arranged between the holding device and the supporting carrier.

Figure 2:
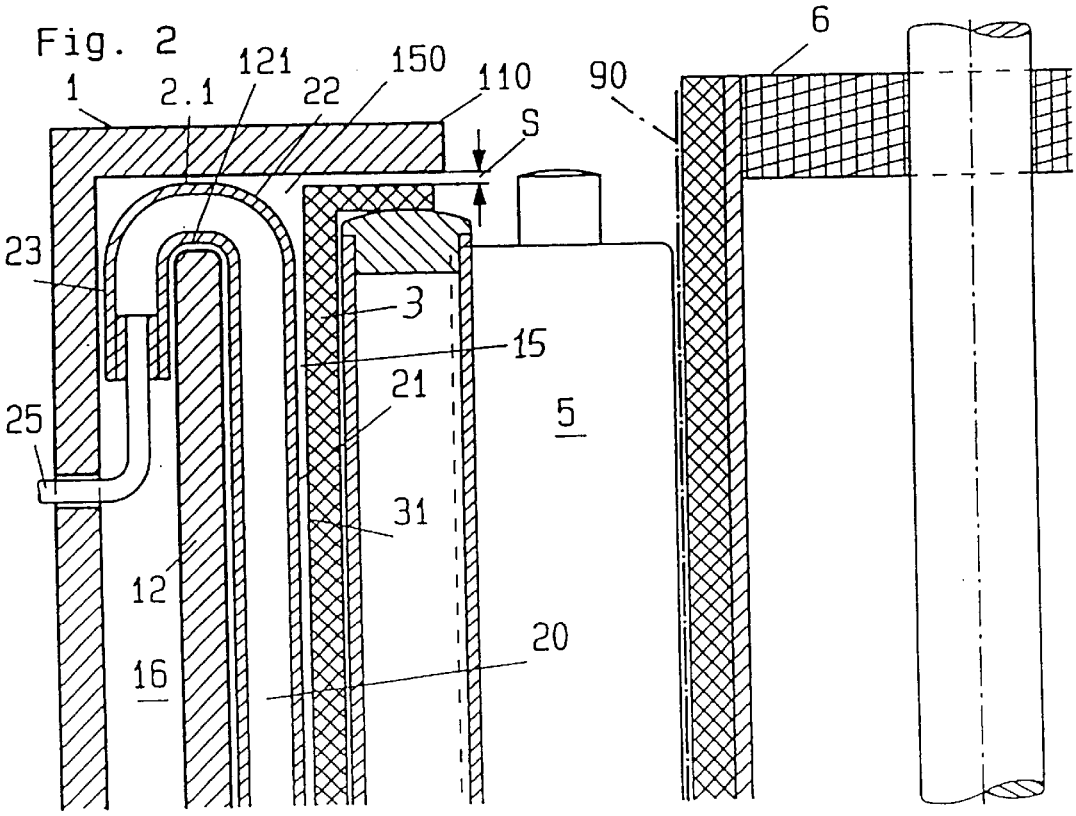
Figure 3:
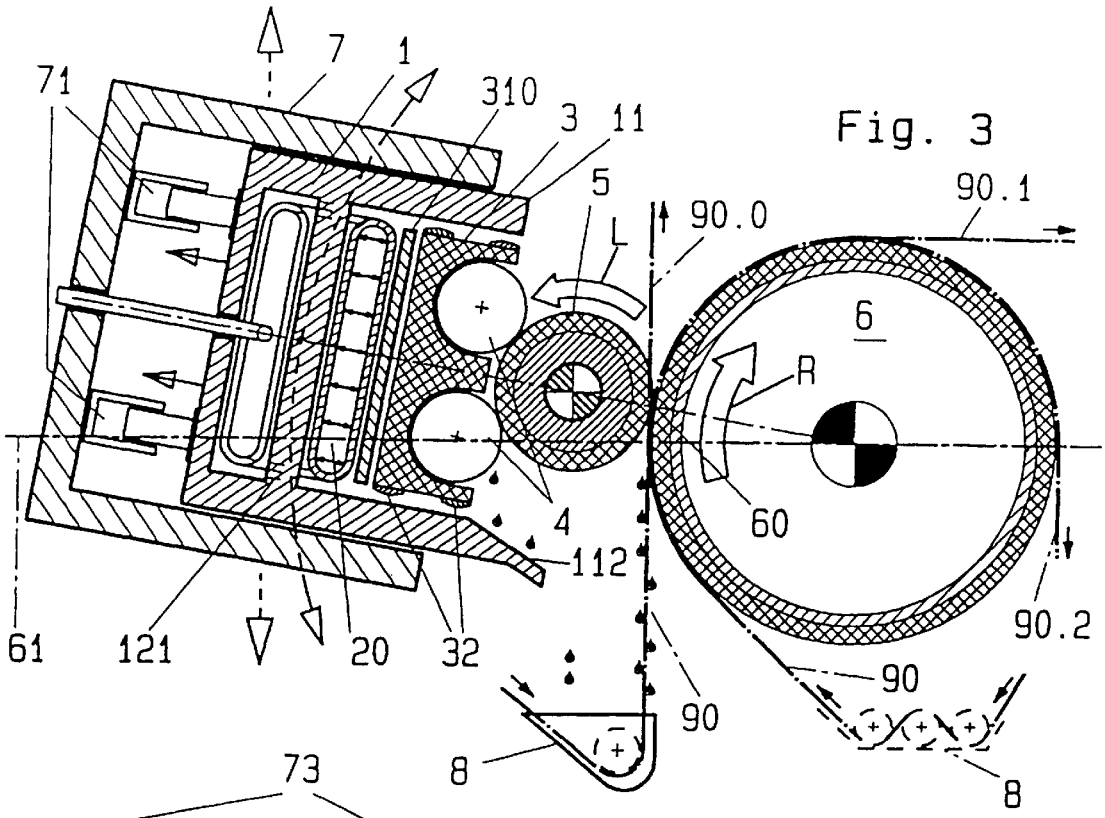
Figure 4:
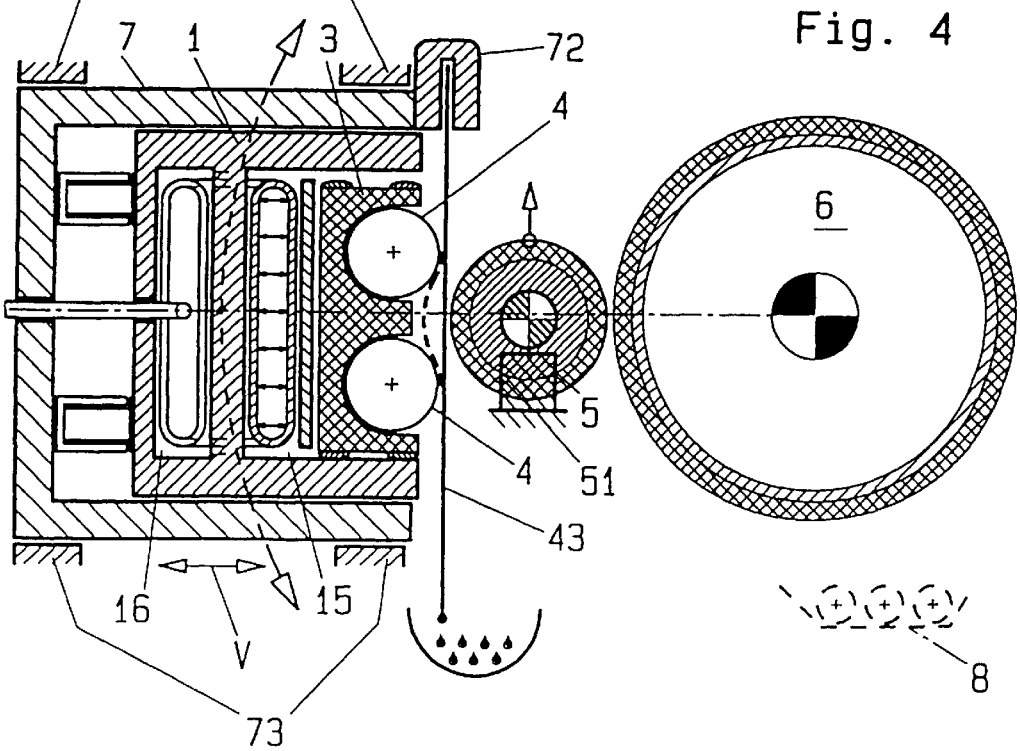
Figure 5A:
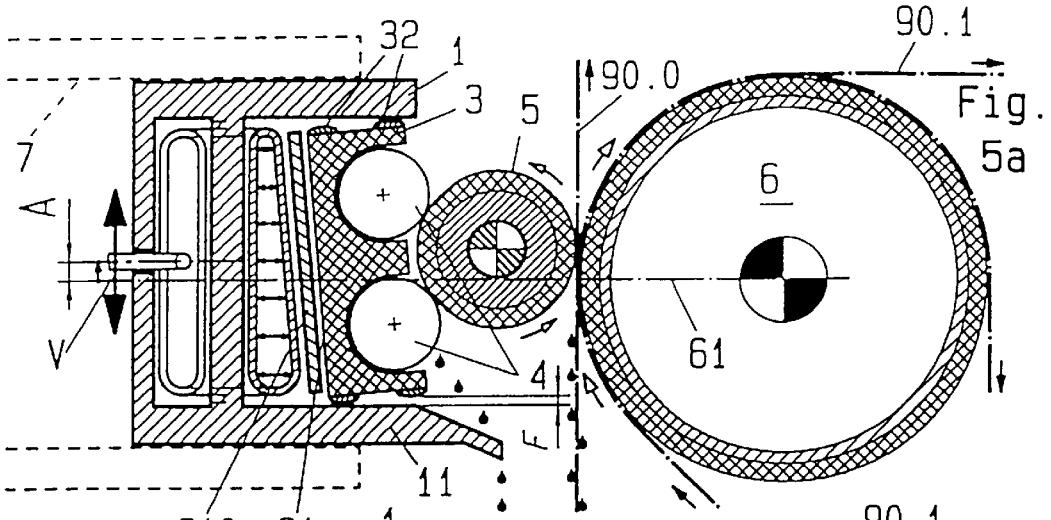
Figure 6:
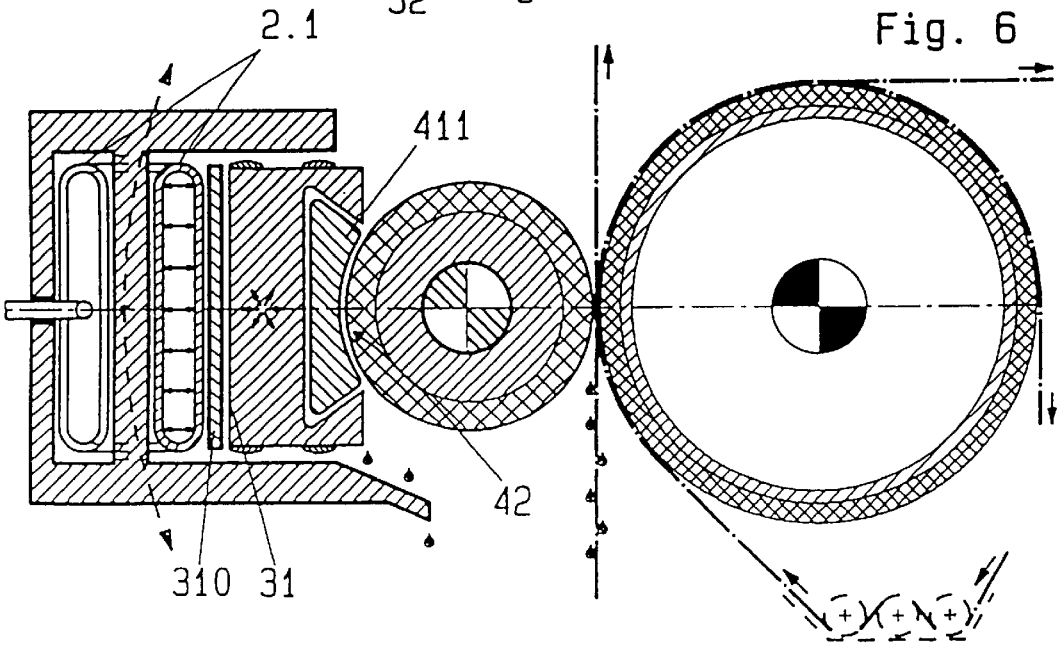
Figures 7, 8:
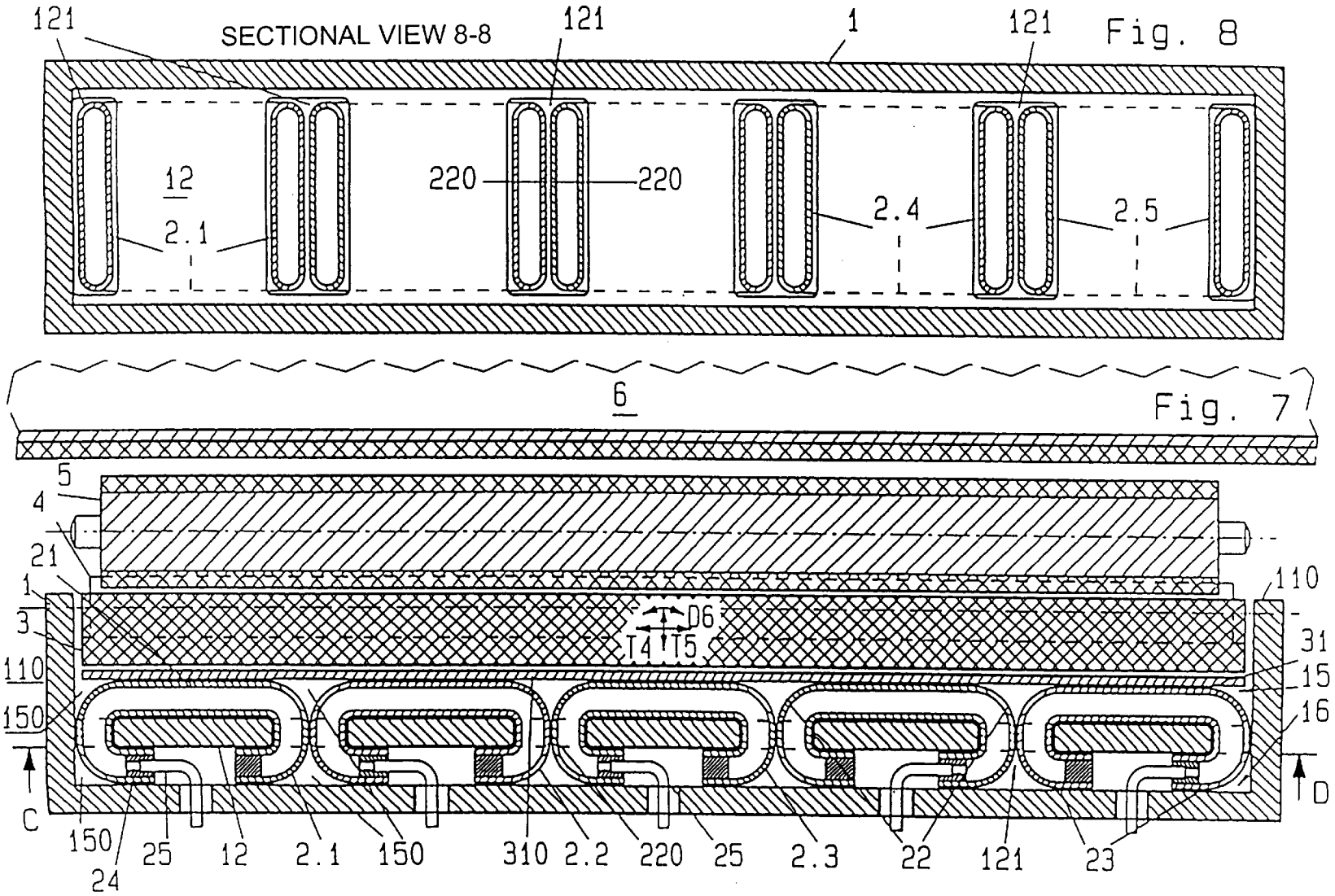
Figure 9:
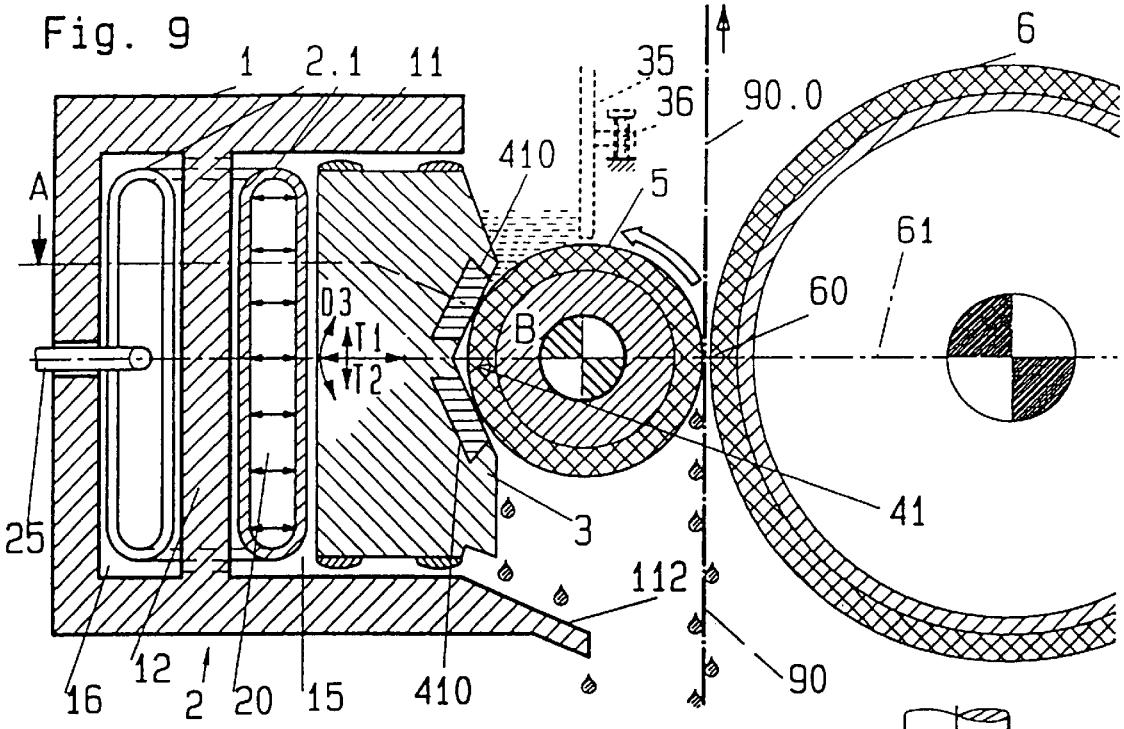
Figure 10:
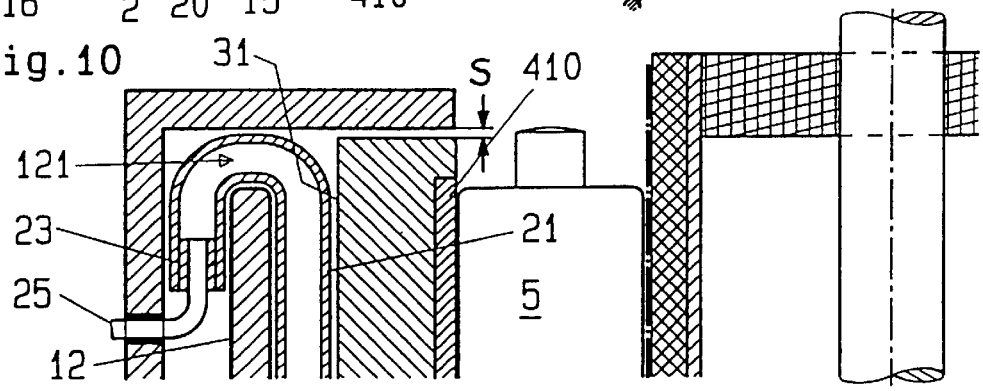
Figure 11:
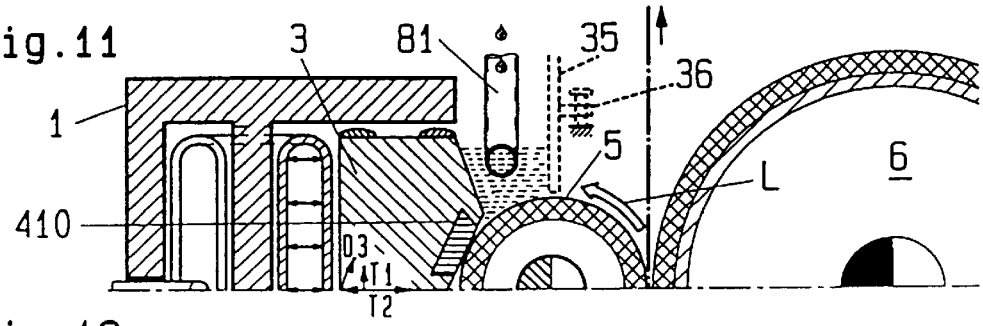
Figure 12:
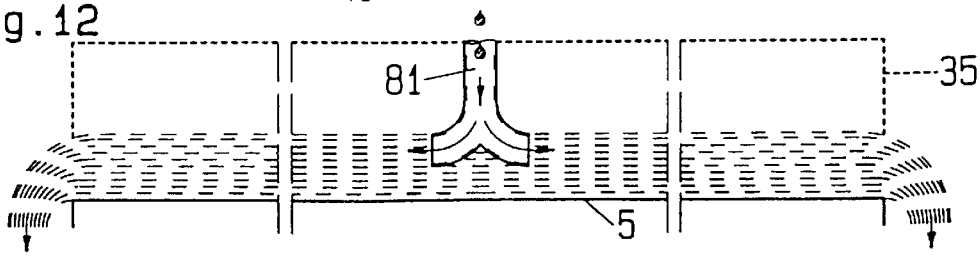

Dependent claims are directed to further useful and advantageous embodiments of the invention and particularly useful and advantageous embodiments of the invention will be described in the following description with reference to the embodiments shown in the schematic drawings. These show:

FIG. 1 a cross-sectional view of an apparatus according to the invention in a working position, FIG. 2 a partial longitudinal sectional view of the apparatus of FIG. 1 from the line 2—2, FIG. 3 a cross-sectional view of the apparatus according to the invention with supporting carrier arranged to pivot about the axis of a mating roller, FIG. 4 a cross-sectional view of an apparatus according to the invention which is inoperative, FIGS. 5*a* and *b* a cross-sectional view of a working apparatus according to the invention with two maximally inclined working positions of a working roller on the lateral crown of a mating roller, FIG. 6 a cross-sectional view of an apparatus according to the invention with a curved sliding mounting for the mating roller, FIG. 7 the apparatus of FIG. 1 in longitudinal section while inoperative with a gap between the working and mating rollers, FIG. 8 the apparatus of FIG. 7 in longitudinal section according to the view 8—8, FIGS. 9 to 11 cross- and partial longitudinal sectional views of apparatus according to the invention with a V-shaped bearing for the working roller and FIG. 12 a partial longitudinal plan view of a flush/cleaning supply of the apparatus of FIG. 11.

Apparatus according to the invention shown in FIGS. 1 to 12 comprise a bearer 1 which forms a transverse supporting holder, a pressing device 2 with a pressure hose element 2.N, a pressure bearing structure 3 supported on the pressure hose element and having bearing elements 4 or 410, 411, a working roller 5 which is mounted with its circumference on the front side of the bearing structure 3 by means of the bearing elements, and a counter support in the form of a mating roller 6. The bearer 1, pressure bearing structure 3 with bearing elements, working roller 5 and mating roller 6 extend over the operational breadth of the apparatus. This corresponds to the width dimension of a web 90 to be processed which passes through the apparatus in a pressing gap (pinch gap) between the working and mating rollers 5, 6, the width dimension extending throughout the length of the apparatus. The working roller 5 is arranged in the region of the lateral crown of the mating roller 6, the axis of rotation of the working roller 5 lying in, or in the region of, a horizontal plane 61 in which the axis of the mating roller 6 lies. The rollers 5, 6 counter-rotate and draw the web 90 upwardly when pressed together for operation. In the embodiments shown, the working roller 5 rotates in an anticlockwise direction L while the mating roller 6 rotates in a clockwise direction as indicated by the arrow R.

The bearer 1 and the mating roller 6 are mounted in a non-shown frame of a processing machine. The mating roller 6 has a substantially larger diameter than the working roller 5 and is driven at its axle ends. The core of the roller preferably consists of stainless steel. The outer surface of the roller 6 may be refined, e.g. chromium-plated or may be equipped with an elastic coating of plastic, rubber or the like. The outer surface of the working roller 3 is preferably rubberised.

The working roller 5 can be connected with a surface drive or an axial drive, the drive being arranged outside the working breadth. The drive of the working roller 5 can be exceptionally selected such that a very low frictional force is exerted in the pinch gap of the working zone 60. On the other hand, it is particularly advantageous to provide the working roller without its own drive. In this way the working roller 5 will roll slightly retarded with the web 90 or the mating roller 6. Friction between the roller 5 and the roller 6 will exist in the working zone 60 as a result of the idle roller 5. It has been found that the idling friction sets itself automatically to adjust to each operational situation ideally when the working roller 5 is arranged without restricted guidance, i.e. with all-round free clearance during pressing operation. The automatic adjustment occurs during minimal pressure on the web 90 and therefore optimal conditions for avoiding web deformation through upsetting and stretching. Conventional disadvantageous results associated with such deformation, such as wear caused by friction, are eliminated.

As shown in FIGS. 1, 3, 5*a* to 6, the web 90 may be either guided perpendicular to the horizontal plane 61 or wrapped around the mating roller 6 upstream and/or downstream of the rollers 5, 6. The web 90 is guided through a dip trough 8, which is filled with a liquid medium (liquor) and is arranged below the processing apparatus, and takes up an increased or reduced amount of liquor depending on its structure and constitution. The web 90, specifically a foulard, is squeezed between the working and mating rollers 5, 6 as it passes the working zone 60. The squeezed out liquid drips back into the trough 8 arranged in the area below the squeezing point. The web, which contains only a minimal amount of remaining liquor after being squeezed may be guided further in a vertical direction (web 90.0) or may usefully be guided to the upper crown of the roller 6 and away from there (web 90.1). It can also be useful to guide the web on the roller 6 beyond its crown (web 90.2). Advantageously, the free edge of the longitudinal wall of the lower bearer is extended to form a drip surface 112 on which the liquor entrained through the pressing zone between the bearing elements of the structure 3 and the working roller 5 is guided back into the trough 8.

In an exemplary embodiment of the invention according to FIGS. 1 to 8, the bearer 1, which during operation is set and fixed in its local position, is divided into a U-shaped front cavity which is open towards the mating roller 6 and a rear flat cavity 16, both of which extend in parallel over the working breadth. The wall between the rear cavity 16 and the front cavity forms a supporting wall 12 with a level supporting surface for the flat sides of straight supporting portions 21 of flat pressure hose elements 2.N. A level supporting surface 31 of the pressure bearing structure 3 lies against the other flat side of the pressure hose elements 2.N.

In a base operational position according to FIGS. 1 and 2 the pressure bearing structure 3 is located with its bearing elements, which are formed by the pressure hose elements 2.N and cylindrical pressing rod structures 4, in contact with the working roller 5. The bearing structure 3 is slidable out of this position under the effect of the hose force in the twin or pressing direction T2 and perpendicular hereto in the twin direction T3 with respect to any point parallel to the horizontal plane 61 when viewed in cross section and is also rotatable about each of these points in the twin direction D3. The pressure bearing structure 3 thus comprises three degrees of freedom when the apparatus is viewed in cross section. These degrees of freedom also exist for the working unit formed during the pressing connection, that is formed when the pressure bearing structure 3 contacts the mating roller 5 with its rod structures 4. It is evident that the working unit 3, 4, 5 has room to manoeuvre both in the pressing direction and transverse hereto to find its operational position. This means that the pressing roller 5 finds the optimal pressing position against the mating roller 6 automatically and easily within this manoeuvring room. This positioning will be termed self-positioning in the following. As apparent from FIGS. 2 and 8, the bearing structure 3 can also be moved with three degrees of freedom T4, T5 and D6 with respect to any point in its plane of section. To this end, a spacing S is provided between the end surfaces of the bearing structure 3 and the end walls 110 of the bearer 1. All embodiments comprise this form of bearing with clearance of the bearing structure 3 or the working roller 5.

In order to achieve the above described degrees of freedom it is important that the bearing structure 3 is arranged without restricted guidance connected to the bearer 1 between the pressure hose elements 2.N and the working roller 5. Usefully positioning elements are arranged on the bearer 1 and associated with the bearing structure 3. According to the embodiment, the positioning elements 11, 110 are formed by the leg portion or end wall of the U-shaped cross-section of bearer 1 which is open towards the mating roller 6. These elements 11, 110 limit the free movement in three degrees of freedom of the bearing structure 3. Thus the bearing structure 3 can freely adopt the displaced or inclined position for example the maximal positions in the cross-sectional view of the apparatus shown in FIGS. 5*a* and 5*b* between these positioning elements. The region of play of operational movement of the pressure bearing structure 3 with three degrees of freedom can be relatively small particularly with small or medium working breadths. It has been found that the spacing F between the inside bearing structure edges and the positioning elements 11 in the diagonal inclined positions according to FIGS. 5*a* and 5*b* should usefully be of the order of 0.5 mm to 5 in order to attain the operational floating movement for self-positioning.

The hollow in the bearer 1 which is open towards the mating roller 6 also forms a holding cavity for the pressure bearing structure 3 for use during preparation and also when the apparatus is inoperative. This is clear from FIG. 4. Here the bearing structure 3 lies against the positioning element 11 which forms the lower longitudinal wall of the bearer 1. In this position the working roller 5 lies with its ends on cradle elements 51 which are arranged outside the operational breadth on the front side of the apparatus.

As is apparent from FIG. 4 a sliding and covering film 43 which extends over the length of the rod structures 4 is arranged between the cylindrical pressing rod structures 4 and the working roller 5. When out of operation the film 43, which is attached at its upper edge to the holding device 7 above the bearer 1 by means of a clamping groove 72, hangs vertically downwards as a planar surface. The film 43 ensures that the rod structures 4 and the bearing structure 3 do not become contaminated by the liquor or liquid. Material which lands on the film runs down the same and falls off its free end into a collection channel. In the operational state, i.e. in the pressed position of the working roller 5 between the rod structures 4 and the mating roller 6, the film forms a gliding surface for the working roller 5. In this position the film 43 is held tensioned between the clamping groove 72 and the rod structures 4 due to the downward direction of rotation of the rollers away from the clamping groove 72 in direction L at the point between the rod structures 4 and the working roller 5. The film 43 and its material are designed such that it curves to adapt to the curvature of the rod structures 4 and the working roller 5; it is thus conformable as indicated by the dashed line in FIG. 4. As a result of the suspended arrangement of the film 43 and its conformability the floating movement of the working roller 5 is not impeded. It is particularly useful when the film 43 is of particularly high gliding quality on both sides.

Figure 5B:
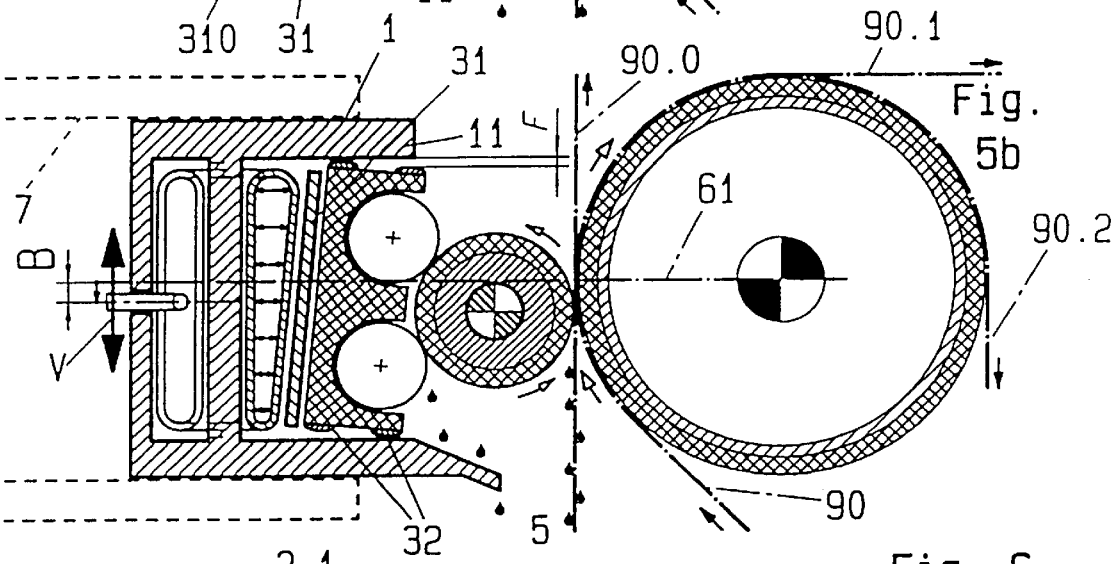

The bearer 1 is preferably held at its ends outside the operational breadth with holding devices 7 of a non-shown spreading machine. It is preferable that the devices 7 are arranged such that their height, i.e. the distance to the horizontal plane 61, is adjustable. The height positions can be fixed. In FIGS. 5*a* and 5*b* are shown two positions of the bearer 1 of FIG. 1 displaced translationally perpendicularly to the horizontal plane 61. In FIG. 5*a* the bearer 1 is displaced slightly upwardly by an amount A while in FIG. 5*b* it is displaced slightly downwardly by an amount B. By means of such a displacement the flow of force for compression can be specifically influenced. Also the contact position of the working roller 5 with the mating roller 6 can be adjusted to a desired (small) amount which allows specific conformity to the nipping values, the web constitution and/or the roller construction. In FIG. 5*a* the working roller contacts the roller 6 just a little above the lateral crown of the latter while in FIG. 5*b* the roller 5 contacts the roller 6 a little below the latter's lateral crown. The self-positioning of the working roller 5 against the mating roller 6 occurs as a result of the displacement and inclined movement of the bearing structure 3.

Ribs 32 are formed on the narrow longitudinal side of the bearing structure 3 continuously throughout the length of the structure. In place of these ribs, corresponding raised elements can be provided. When the bearing structure is viewed in the corresponding cross-sectional diagonal the ribs form tipping edges which lie against the positioning elements 11, or, as shown in FIG. 4, feet enabling the bearing structure 3 to stand on the lower wall when out of operation.

The operational displacement arrangement of the working roller 5 described with reference to FIGS. 5*a* and 5*b* can also usefully be achieved by arranging the bearer 1 to be rotatable about the axis of the mating roller 6 and fixable in a rotational position as shown in FIG. 3. The inclined position attained in this manner is particularly favourable for the adaptation and self-positioning of the bearing structure 3.

As specifically shown in FIGS. 3 and 4 the holding device 7 is formed by a transverse carrier open towards the mating cylinder 6 which is mounted at a lateral end outside the working breadth and can be set and adjusted in position. As can be seen from FIG. 4 a mounting 73 for the holding device 7 can be formed by an auxiliary device which is stationary with respect to the machine and comprises bearing elements and slides the holding device 7 transverse to the working roller 5 in direction V. In the desired position, the device 7 is fixed so that it forms a stationary holding structure during operation.

The holding device 7 also constitutes a sliding receptacle for the bearer 1. A pneumatically driven moving device 71 is arranged between the rear wall of the transverse carrier and the rear wall of the bearer 1 and is used to adjust and fix the spacing between the bearer 1 and the mating roller 6. Specifically operation of the moving device 71 allows the bearer 1 to be pulled back into the sliding receptacle of the holding device 7 in order to allow sufficient preparation room for drawing in a web 90 and/or changing the working roller 5 or the mating roller 6. Likewise it is possible that the holding device be moved in its holder 73 away from the mating roller 6 in order to free the film 43 and the working roller 5 on the longitudinal sides, as shown in FIG. 4.

For the objects of the invention the working roller 5 is uniquely surface mounted on the pressure bearing structure 3 by means of bearing elements arranged exposed on the front side of the bearing structure. As shown with reference to the embodiments it is useful that the bearing elements are cylindrical pressing rod structures 4 with identical circular cross sections and with a diameter which is smaller than that of the working roller 5. The rods 4 can be fixedly arranged or be provided as rotary rollers 4 mounted in corresponding roller bearings of the bearing structure 3. It has been found that, depending to the self-positioning state, one or both rollers may be stationary during operation, i.e. when the working roller 5 rotates without being driven. For the roller 4 which counter-rotates with the working roller 5 the velocity of rotation of the roller 4 is from time to time considerably lower than that of the roller 5. During self-positioning the pressure bearing structure 3 can shift about the working roller 5, i.e. in a curve corresponding to the diameter of the working roller, by a suitable amount. The rod roller surface mounting for the working roller 5 is also particularly advantageous as it enables the use of replacement working rollers 5 with different diameters.

As shown in FIG. 6 the floating movement according to the invention can also be obtained by using a curved sliding mounting instead of the rod rollers 4. A sliding moulding 411 forms a receptacle adapted to the form of the working roller 5 for receiving the same. It is usefully provided as an independent support structure which is captively insertable into a complementary socket having a trapezoidal sectional form in the pressure bearing structure 3.

In the embodiment of FIGS. 9 to 11 there is provided a sliding mounting 41 of V-shape cross section for the working roller 5 in place of the rod roller bearing. An obtuse receiving angle is formed between two planar pressing plates 410 against each of which the working roller 5 is supported substantially tangentially. The pressing plates 410 are usefully detachable integrated in the pressure bearing structure 3, for example by means of a trapezoidal snug-fitting plug and socket captive arrangement as shown in FIGS. 9 and 11.

The supporting structure or surfaces which belong to the pressure bearing structure and lie directly against the working roller 5 are advantageously made of polytetrafluorethylene of high gliding quality or similar material, the parts being either comprised entirely of this material or coated with it.

As apparent from FIG. 1 the working roller 5 mounted according to the invention can usefully be associated with a dividing wall 35 which is firmly connected to a spreading device. This wall extends over the working breadth parallel to the bearer 1. The free lower longitudinal edge of the wall 35 extends to within an adjustable spacing of the upper crown of the working roller 5. When the spacing is set to be small a hydrodynamic sealing gap is formed. This has the effect that substances such as ink liquor which collect in the wedge-formed area between the upper rod structure 4 located downstream of the upper crown of the working roller 5 in the direction L and the working roller 5 is retained such that it cannot run back over the upper crown of the roller 5 into the operational zone 60. Thus the substance can run into this triangular area in the direction of rotation L of the roller 5 but it is prevented from running back against the direction of rotation as a function of the dimensions of the lower wall 35 thickness and the spacing. The spacing is large enough not to impede the self-positioning of the roller 5. The spacing is set to allow for possible changes of position of the roller 5 during operation so that the wall 35 will not touch the roller 5. The dividing wall 35 is fixed at its two lateral ends to the frame of a processing machine. The wall 35 is usefully associated with an adjustment device 36 by means of which it can be raised or lowered into the desired position relative to the roller 5.

The accumulation of substance in the wedge tends to occur particularly when the web 90 has a porous, netting- or grid-like structure. After compression, particles of the more or less viscose substance remain adhered to the roller surface at positions corresponding to recessed or open web portions and are collected in front of the rod structure 4 since a relatively large seal effect is present between the latter and the working roller 5. It has been shown that by using the dividing wall 35 a relatively high substance level can be built up in the wedge downstream of the wall 35 in the direction of rotation L, even when substances of relatively low viscosity are used. A channel is formed between the rod structure 4, the roller 5 and the dividing wall 35 which extends between the two lateral ends of the apparatus. The accumulated substance is drawn off from one end of this channel and guided into the trough 8 via the ends of the working roller 5. By means of this dividing wall 35 in combination with the bearing structure 3 mounting according to the invention it is possible to pinch or compress, and e.g. to colour, webs which have irregular or uneven structures. Any substance remains that fall behind the compression zone will be drawn off by means of the sealing gap. It is also advantageous that the dividing wall 35 serves as a protective shield for operators.

A cleaning device 81 in the form of a flush and cleaning supply is shown in FIGS. 11 and 12. A central conductor extends into the middle area of the apparatus breadth and from here branches out into cleaning fluid supply outlets along the working breadth. While the working roller 5 is still in its pressing condition, substance remains from the wedge region will become loosened and flushed away towards the apparatus lateral ends. The cleaning device 81 is advantageously provided in combination with the retaining reservoir formed by the dividing wall 35.

The floating arrangement of the pressure bearing structure 3 is obtained in combination with pressure hose elements 2.N arranged according to the invention. In the embodiment there is advantageously provided an odd number of hose elements, specifically five, 2.1 to 2.5. As apparent from FIGS. 7 and 8 these form compression zones of equal width which are arranged side by side to cover the whole working breadth. The compression zones can also be formed of different lengths. Each hose element 2.N is connected to a pressure medium, e.g. a compressed air source by means of an associated connecting tube 25. The pressure and content condition of each hose element 2.N is adjusted by means of a controllable valve which is connected in the tube 25. The pressure medium sources and valves are not shown in the drawings. The desired uniform or non-uniform operation state across the working breadth is obtained by selecting the pressure within the hose elements 2.N. By dispensing with the lateral compression zones the apparatus can be used for webs having a width which is smaller than the length of the bearing structure 3.

The pressure hose element 2.N comprises two U-shaped bent portions 22 curving away from the counter support surface 31 of the pressure bearing structure 3 towards the rear side of the apparatus. As is shown particularly in FIGS. 2 and 8 the pressure hose element 2.N is a flat extending hose piece shaped as an open elongate oval ring when the apparatus is viewed in longitudinal section. This hose element 2.N sits snugly in the rear flat cavity 16 of the bearer 1 and the flat cavity 15 located between the wall 35 dividing the two cavities 15, 16 and the planar counter support surface 31 of the pressure bearing structure 3. The support portion 21 of the hose element 2.N which extends continuously and straight in the longitudinal direction of the bearing structure 3 forms a flat pressure chamber 20 which fills the flat cavity 15 when the bearing structure 3 is viewed in cross section. As apparent from FIGS. 5*a* and *b,* the portion 21 conforms to the sectional profile of the flat cavity 15 which is trapezoidal when the bearing structure 3 is inclined. By means of this conformability and the free seating of the bearing structure 3 on the hose portion 21, the floating position of the bearing structure is stabilised.

Each oval hose element 2.N is arranged completely within the bearer 1 and is specifically freely held in the cavities 15, 16 without firm attachments to the bearer 1. As shown particularly in FIGS. 7 and 8, the supporting wall 12 is provided with recesses or openings 121. The cross section of these openings corresponds at the end wall to a single hose cross section and elsewhere to two hose cross sections. Each wall portion between two openings 121 forms a support core for the oval hose element, and the U-shaped bent portions 22 when viewed in longitudinal cross section penetrates into the flat cavity 16 such that the straight portion of the hose ring is interrupted in the cavity 16. When viewed in the longitudinal cross section the cross section of the hose is equal to the corresponding cross section of the cavity 16. The rearwardly curved portions of adjacent bent portions are located in the wider openings 121 and press against one another. The straight hose portions 21 lie in a row on the counter support surface 31. Hose-free gaps 150 created by the bent hose por-tions 22 are located between the support portions 21 of adjacent hoses and define the spacing between these support portions 21. Hose-free gaps 150 are also created where the bent portions 22 contact the front walls 110 and the rear inner wall of the cavities 15, 16.

The free end portions 23 of the oval pressure hose elements 2.N are closed with sealing structures 24, the sealing structure 24 at one end 23 forming a connecting part for connecting with the preferably flexible connection tube 25. The latter extends through an opening rearwardly out of the bearer 1.

In FIG. 2 the rearward side of the bearing structure 3 forms a direct planar counter support surface 31. As shown in FIGS. 3 to 8 a continuous intermediate plate 310 which extends across the working breadth can be usefully arranged between the hose support portions 21 and the rear side of the bearing structure 3. This then forms the counter support surface 31 for the support portions 21 of the hose elements 2.N. Preferably the plate 310 is very thin i.e. only a fraction of the width of the rear wall 12. The width of the wall 12 is of the order of the cross-sectional width of the cavities 15, 16. The intermediate plate 310 consists of a material able to conform to flexure. It serves to transfer a uniform continuous pressure from pressure zones of unequal pressure at the boundary and so achieve a uniform pressure distribution between the pressure hose elements 2.N and the pressure bearing structure 3. The bearing structure, which is specifically made of plastic or other synthetic material, is thus protected against the adverse effects of different pressure forces. A further advantage in providing the intermediate plate 310 is that the bearing structure 3 can have a smaller cross-sectional dimension.

The pressure hose elements 2.N are preferably strengthened with fibre such that the wall material is non-expandable to such an extent that even when the hose is exposed to particularly high pressure the hose elements 2.N are reliably prevented from expanding into the hose-free gaps 150. These gaps 150 and the convexly curved bent portions 22 are therefore pronounced for all exerted pressures.

What is claimed is:

1. An apparatus for processing web-shaped material (90) comprising a working roller (5) extending in the longitudinal direction of the apparatus, a counter support (6) forming a counter support surface against which the web material (90) is pressable over the whole working breadth, which corresponds to the web width, by means of the working roller (5), a pressure bearing structure (3) with a front side for surface mounting the working roller (5) on this front side and applying a pressing force to said working roller, a supporting carrier (1) extending in the longitudinal direction of the apparatus, the pressure bearing structure (3) and a supporting wall (12) of the supporting carrier (1) being arranged to be movable relative to one another in the pressing direction, and a pressing device (2) for generating a pressing force, the pressing device (2) comprising a cavity (15) between said pressure bearing structure (3) and said supporting wall (12), and a pressure hose arranged in said cavity (15), said cavity (15) extending in the longitudinal direction of the apparatus and changing with said relative movement, a pressing chamber (20) with oval or flat cross section being provided between a counter support surface (31) for the hose formed on said pressure bearing structure (3) and the supporting wall (12) for applying a pressing force over the rear side of the pressure bearing structure, the pressing volume of said pressing chamber being defined by the amount of pressing medium contained in the pressure hose, characterised in that the pressure hose is provided as a pressure hose element (2.N) which comprises an L-, U- or oval-shaped form when the apparatus is viewed in longitudinal section, at least one bent portion (22) directed away from the counter support surface (31) for the hose towards the rear side of the apparatus and a supporting portion (21) adapted to lie in planar fashion against said counter support surface (31) for the hose, a hose free space (150) being formed within said cavity (15) at each filling state of the hose by each bent portion (22) between said counter support surface (31) for the hose and the supporting wall (12).

2. An apparatus as claimed in claim 1, characterised in that a working unit formed by said pressure bearing structure (3) and the working roller (5) in pressing relationship is arranged between the counter support (6) and the pressure hose element (2.N) such that the working unit (3, 4, 5) is movable without restrictive guidance in both the pressing direction and transverse thereto.

3. An apparatus as claimed in claim 1, characterized in that the wall material of the pressure hose element (2.N) is resistant to stretching to the extent that the bent portion (22) of said hose is substantially non-expandable with each application of pressure to form said hose-free space (150).

4. An apparatus as claimed in claim 1, characterized in that the supporting carrier (2) comprises at least a second rear cavity (16) arranged at the rear side of the apparatus, the bent portion (22) of the hose extending into the second cavity (16) while being supported on at least one inner wall of the cavity.

5. An apparatus as claimed in claim 4, characterised in that the second rear cavity (16) is connected to said first cavity (15), which accommodates said supporting portion (21) of the hose, by means of at least one opening (121), the bent portion (22) of the hose penetrating into said opening (121).

6. An apparatus as claimed in claim 5, characterised in that the supporting wall (12) forms a supporting core for the surrounding hose element (2.N) between two openings (121).

7. An apparatus as claimed in claim 4, characterized in that the hose element (2.N) is an open oval-shaped ring with free end portions (23) which are received in the second cavity (16), one end portion (23) of the hose being connected to a connecting tube (25) for a pressure medium which extends out of the supporting carrier (1).

8. An apparatus as claimed in claim 1, characterized in that several pressure hose elements (2.1 to 2.5) are provided distributed in a row over the length of the supporting carrier (1), each hose supporting portion contacting a respective counter support surface for the hose (31) associated with the pressure bearing structure (3) and hose free spaces (150) being formed by the bent hose portions (22) between adjacent hose support portions (21) to separate the same, the rearwardly directed portions (220) of adjacent bent portions (22) being preferably in mutual pressing contact.

9. An apparatus as claimed in claim 1, characterized in that the working roller (5) is mounted by means of a trough-like recess (41, 42) provided on the front side of the pressure bearing structure (3), the recess having at least one supporting surface or lines for the working roller (5) which is formed by at least one contact structure (4, 410, 411) integrated in the pressure bearing structure (3) for facilitating sliding contact, the contact structure (410, 411) being detachably mounted on the pressure bearing structure (3) in particular by means of a captive connection.

10. An apparatus as claimed in claim 1, characterized in that the working roller 95) is mounted by means of two cylindrical pressing rod structures (4) which are exposed on the front side of the pressure bearing structure (3), the pressing rod structures (4) being preferably of the same circular cross section and held in recesses adapted to their form in the pressure bearing structure (3).

11. An apparatus as claimed in claim 1, characterized in that the working roller (5) is mounted by means of a receptacle (41) with V-shaped cross section provided on the front side of the pressure bearing structure (3).

12. An apparatus as claimed in claim 1, characterized in that a sliding film (43) is provided between mounting elements (4) which support the working roller (5) and are arranged on the front side of the pressure bearing structure (3) and the working roller (5), the working roller (5) lying against the mounting elements (4) through the film (43) in operation.

13. An apparatus as claimed in claim 1, characterized in that the transverse movement of the pressure bearing structure (3) is limited by at least one positioning element (11) which is associated with the pressure bearing structure (3) and connected to the supporting carrier (1).

14. An apparatus as claimed in claim 13, characterised in that the supporting carrier (1) has an L- or U-shaped cross section and is open towards the working roller (5), at least one leg of the supporting carrier forming a positioning element (11) for the pressure bearing structure (3) and each leg of the supporting carrier (1) preferably extending beyond the pressure bearing structure (3).

15. An apparatus as claimed in claim 1, characterized in that the supporting carrier (1) is adjustable to alter its position relative to the counter support (6) and fixable in any position by means of a holding device (7).

16. An apparatus as claimed in claim 15, characterised in that the supporting carrier (1) is arranged to pivot about an axis extending parallel to the longitudinal axis and outside the profile section of the supporting carrier, the axis preferably being the axis of a mating roller (6) constituting the counter support.

17. An apparatus as claimed in claim 15, characterized in that a moving device (71) for adjusting and fixing the spacing between the supporting carrier (1) and the counter support (6) is arranged between the holding device (7) and the supporting carrier (1).

18. An apparatus as claimed in claim 1, characterized in that a flexible intermediate plate (310) is arranged between the hose support portions (21) and the rear side of the bearing structure (3) to extend continuously along the length of the bearing structure (3) for effecting a uniform and continuous transfer of pressure between pressure zones subjected to different pressures.

19. An apparatus as claimed in claim 1, characterized in that the counter support is a mating roller (6) and the working roller (5) is movable into contact with the mating roller (6) in the region of the lateral crown of said mating roller.

20. An apparatus as claimed in claim 1, characterized in that a dividing wall (35) extending parallel with the supporting carrier (1) is associated with the working roller (5) and arranged, when viewed in the direction of rotation of the working roller (5), behind the counter support (6) and between the latter and the pressure bearing structure, a hydrodynamic sealing gap being formed between a longitudinal edge of the dividing wall (35) and the surface of the working roller (5) and being adapted to allow passage only to those substances occurring on the rotary working roller (5) which move in the direction of rotation of the working roller (5).

* * * * *